United States Patent [19]

Bokenkamp

[11] 3,981,369

[45] Sept. 21, 1976

[54] RISER PIPE STACKING SYSTEM

[75] Inventor: Donald G. Bokenkamp, Houston, Tex.

[73] Assignee: Dolphin International, Inc., Houston, Tex.

[22] Filed: Mar. 31, 1975

[21] Appl. No.: 563,736

Related U.S. Application Data

[62] Division of Ser. No. 434,651, Jan. 18, 1974, Pat. No. 3,895,677.

[52] U.S. Cl. ..... 175/5; 175/85; 166/.5

[51] Int. Cl.[2] ..... E21B 19/00

[58] Field of Search ..... 175/5–10, 175/52, 85; 116/.5; 114/.5 D

[56] References Cited

UNITED STATES PATENTS

| | | | |
|---|---|---|---|
| 3,189,093 | 6/1965 | DeVries | 166/.5 |
| 3,322,191 | 5/1967 | Bullard | 175/7 X |
| 3,333,562 | 8/1967 | Deal et al. | 175/5 X |
| 3,498,392 | 3/1970 | Knorr | 175/5 |
| 3,592,347 | 7/1971 | Kelly et al. | 114/.5 D |
| 3,613,906 | 10/1971 | Deyo et al. | 175/85 X |
| 3,708,024 | 1/1973 | Back | 175/85 X |
| 3,717,002 | 2/1973 | O'Brien et al. | 166/.5 X |
| 3,817,412 | 6/1974 | Mercier et al. | 114/.5 D |

*Primary Examiner*—Frank L. Abbott
*Assistant Examiner*—Richard E. Favreau
*Attorney, Agent, or Firm*—Donald H. Fidler

[57] ABSTRACT

An offshore drilling rig that embodies a means for vertical stacking of riser pipe sections and blowout preventors below a derrick floor and includes riser pipe manipulating mechanisms for transporting units in a vertical condition between a storage area and the operational area. In the operational area, the cellar floor is provided with a sliding door mechanism which is selectively capable of supporting either the blowout preventor and riser weight, or the blowout preventor. The transportation system includes means for lifting and supporting a riser pipe section vertically and movable in transverse and longitudinal, horizontal directions for transporting pipe sections in a vertical condition.

10 Claims, 8 Drawing Figures

RISER PIPE STACKING SYSTEM

This application is a divisional application based upon my copending Application Ser. No. 434,651, filed Jan. 18, 1974, now Pat. No. 3,895,677, issued July 22, 1975.

BACKGROUND OF THE INVENTION

This invention relates to offshore drilling rigs and more particularly, to structures in a rig for storing riser pipe sections and blowout preventors in a vertical condition below the derrick floor and for transporting such units in vertical condition between storage and operational areas.

In offshore drilling rigs, it is customary to have a string of interconnected tubular pipe sections extending from the rig to a blowout preventor means (sometimes hereinafter referred to as BOP) set on the ocean floor. The drilling string is then inserted through the tubular pipe string (called a "riser") for the drilling of the earth formations below the ocean floor.

On most rigs during the installation or removal of a riser pipe system, the riser is set or supported dependently on the rotary table and connections of riser pipe sections are made at the rig or derrick floor level. When not in use, the lengths of riser pipe sections are usually passed through a V-door and supported horizontally on a pipe rack by means of a rig crane. This manipulation of a riser pipe sections between a horizontal position on a pipe rack and a vertical passage through the rotary table is similar to the operation required for running casing strings. The operation requires virtually the full drilling crew as well as crane operators and roustabouts.

During rough weather, the riser sections are hard to control while hanging on the crane-sling lines. Tag lines are an aid but the chance for injury to personnel or damage to the riser is great. Actually, the problem of retrieving riser sections often comes about because of bad weather where it is desired to pull the riser string.

In the present invention, enough clearance is provided between a lower cellar deck and the derrick floor to rack or store the riser sections vertically under the derrick floor. The advantages of this concept include:

1. The need to lay down the riser pipe joints on the pipe rack is eliminated;
2. Wind or dynamic loading on the derrick is not increased as it would be if the riser were racked in the derrick;
3. More pipe rack area is available for other tubulars;
4. The hazard to equipment and personnel created by frequent crane handling is eliminated;
5. The same storage area is used for transit that is used while pulling or running;
6. The number or personnel required to handle the riser is reduced;
7. The time necessary to run or pull the riser is decreased; and
8. The capability for handling the riser in more severe weather is increased.

SUMMARY OF THE INVENTION

The present invention includes the provision of a cellar floor below a drilling floor with a clearance greater than the length of a riser pipe section. Vertically stacked on the cellar floor in storage area are riser pipe sections necessary for the drilling operation. Each riser pipe has its lower open end receive a stub fixed to the floor and its upper end is supported between upper channel arms. A transportation mechanism is provided for movement to and from and opening in the cellar floor to the riser storage area. In this regard, the transportation system has capability for transverse and longitudinal, horizontal directional movement and vertical lifting movement. Means are provided for independent motion in any of the three coordinate directions. The transportation means include a bridge type crane mounted for movement on a pair of rails. A vertical lifting device is mounted for sliding movement along a transverse beam of the crane. At the cellar floor opening is a first pair of supporting arms for engaging and supporting blowout preventors where the supporting arms are spaced at appropriate distances relative to blowout preventors sizes. The separate pair of supporting arms utilize the same space but can be selectively employed.

BRIEF DESCRIPTION OF THE DRAWINGS

The present invention will become more apparent when the following description is taken in connection with the drawings in which:

FIG. 7 is a plan view of the transporting system for riser pipe and BOP means.

DESCRIPTION OF THE INVENTION

Figure 1:
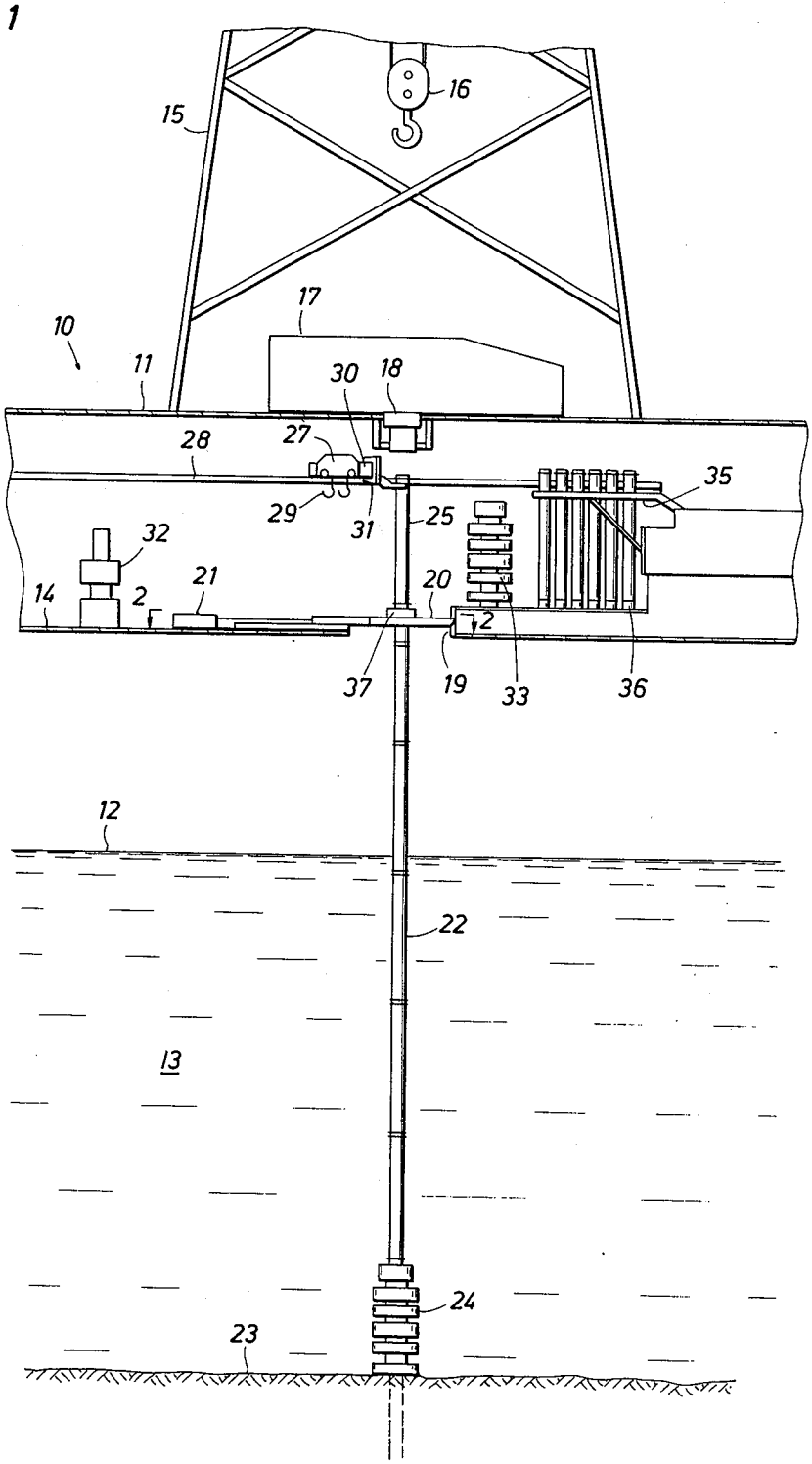
FIG. 1 is a schematic representation of an offshore rig embodying the riser pipe handling system of the present invention.

Referring now to FIG. 1, an offshore rig or drilling barge 10 which can be a semi-submersible which supports a drilling floor 11 above the surface 12 of the ocean 13. Below the drilling floor 11 is a cellar deck or floor 14. The clearance between the cellar floor 14 and drilling floor 11 is made adequate to permit vertical stacking of riser pipe sections between the two floors 11 and 14. On the drilling floor 11 is a derrick 15 equipped with a traveling block 16, draw works 17, and a rotary table 18. Vertically aligned with the rotary table 18 is an opening 19 (sometimes called a moon pool opening) in the cellar floor 14. A special two-stage horizontally movable door 20 is movable between an extended position over the opening to support selectively either a riser pipe section or a blow out preventor (hereinafter referred to as BOP). The door 20 is powered by suitable hydraulic or mechanical means which is schematically illustrated by the numeral 21. The door powering means 21 is capable of horizontally reciprocating the door 20 relative to the opening 19 between an extended position over the opening or a retracted position where the opening is entirely clear. As illustrated in FIG. 1, a riser pipe string 22 is extended from the cellar floor 14 to the ocean floor 23. The riser string 22 is comprised of the usual tubular riser pipe sections or joints which are connected to one another. At the bottom of the riser string is a BOP means 24 which attaches to the ocean floor well head connection. The BOP means 24, as illustrated, has an enlarged cross-section as compared to the cross-section of a riser pipe section. The vertical clearance between the cellar floor and derrick floor is such that one of the riser pipe sections 25 can be vertically disposed in the clearance between the rotary table 18 in the drilling floor and opening 19 in the cellar floor. The riser pipe sections and BOP means have support means (to be explained later) which are engageable by the door 20 to support the riser string 22 while a riser pipe section 25 is added or substracted from the riser pipe string.

Means for moving a riser pipe section in the space between the drilling rig floor and cellar floor include a bridge crane 27 which is mounted for movement in one horizontal direction by spaced apart guide rails 28 (only one shown). The crane includes wire lines 29 for moving the BOP means vertically with respect to the cellar floor. A transverse beam 30 on the bridge crane extends between the guide rails 28. A fork lift type device 31 is mounted for movement along the length of the beam 30 and is also capable of vertical movement relative to the transverse beam 30. The purpose of this arrangement is to transport riser pipe sections or BOP means in a vertical condition between the cellar opening 19 and storage areas. The storage area for the BOP means is to either side of the opening as shown by the illustration of upper and lower BOP stacks 32 and 33. The storage area for the riser pipe sections includes upper fingers 35 which are arranged to receive the upper portion of the riser pipe sections and stubs 36 set along the cellar floor for receiving the open lower end of each riser pipe section.

In the overall operation of the system, the crane 27 first picks up the lower section 33 of a BOP and moves it to the opening 19. The BOP portion 33 is lowered partially through the opening with the door 20 in a retracted condition. Then, the door 20 which has beams for supporting the BOP 33, is moved to an extended position where the door arms support the BOP portion 33 relative to the cellar floor. The bridge crane 27 is then used to move the upper BOP section 32 over the lower section and the BOP sections are connected. After connection of the upper BOP section 32 to the lower BOP section 33, a single joint of riser pipe that has been pre-positioned on the hook of the traveling block 16 by means of a running tool (not show) is lowered through the rotary table 18 and connected to the top of the assembled BOP stack. The BOP stack is then picked up sufficiently for clearance and the sliding door 20 is retracted to allow passage through the cellar deck opening 19 of the BOP. After the BOP has been sufficiently lowered to clear the cellar deck opening 19, a second pair of door arms are engaged to the first set of door arms that previously supported the BOPs. The interconnection of the two sets of arms is accomplished while the door is in the retracted position. The door 20 is then manipulated again to extended position with the now interconnected second set of arms that are spaced apart sufficiently to provide clearance for the riser and to support a riser spider 37 which will support the riser section and BOP connected to it. The riser spider 37 is then installed around the riser and supported by the second set of arms. The riser is then set in it. The running tool (not shown) is then released and pulled up sufficiently to provide clearance for the next joint of riser. The fork lift device 31 is moved to the riser pipe section storage area and another riser pipe section is picked up vertically and transported in a vertical condition to the cellar opening 19 where it is lowered and coupled to the riser joint setting in the riser spider. The running tool (not shown) attached to the traveling block 16 is lowered through the rotary table 18 attach to the connected riser pipe section. After connection with the running tool, the assembled stack is picked up sufficiently to release the spider and then is lowered until the second riser pipe section is in position to be supported by the riser spider 37. This sequence is repeated for the other riser pipe sections as needed. The operation is reversed for pulling the riser string.

Figure 2:
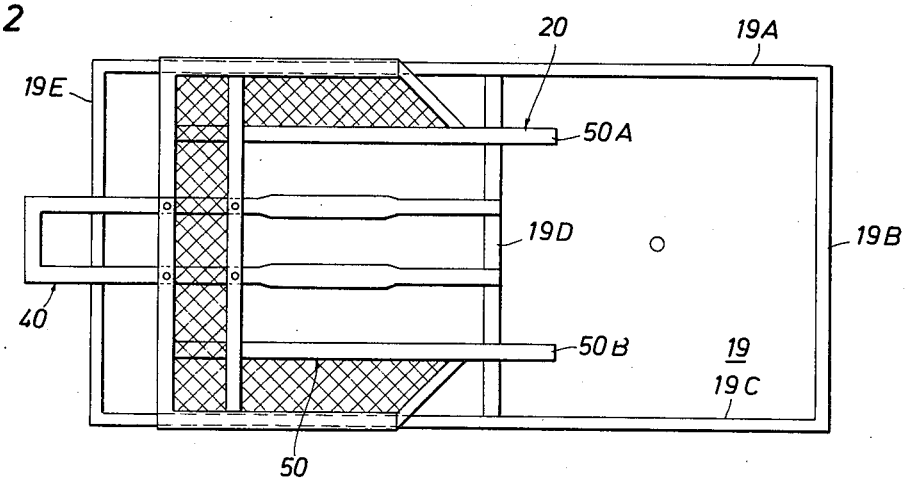
FIGS. 2 – 4 are plan views of the door and opening in extended and retracted positions.

Referring now to FIGS. 2 – 5, the door 20 and opening 19 are shown in greater detail. The opening 19 is defined by a rectangular shaped frame comprised of frame components 19 (*a–d*) which attach to the cellar floor. The side frame components or members 19*a* and 19*c* are elongated and attached to an end frame member 19*e*. In FIG. 2, the door 20 is in a retracted position and rests upon the frame members 19*e*, 19*a*, and 19*c* and 19*d*. The door 20 includes two sets of generally U-shaped gate members. A first U-shaped member 40 is shown most clearly in FIG. 3.

The gate member 40 has a length greater than the span between the frame members 19*d* and 19*e*, and its open end lies on the transverse frame member 19*d* in the retracted position of the gate member. The U-shaped gate member 40 includes a pair of longitudinally extending bar members 40*a* and 40*b* which are spaced apart a distance compatable with the outer diameter of a riser pipe section so that a riser pipe section can be supported by a riser spider installed on the gate member 40. For supporting riser pipe sections, a conventional riser pipe spider is also employed but is not shown for clarity of illustrations.

Figure 3:
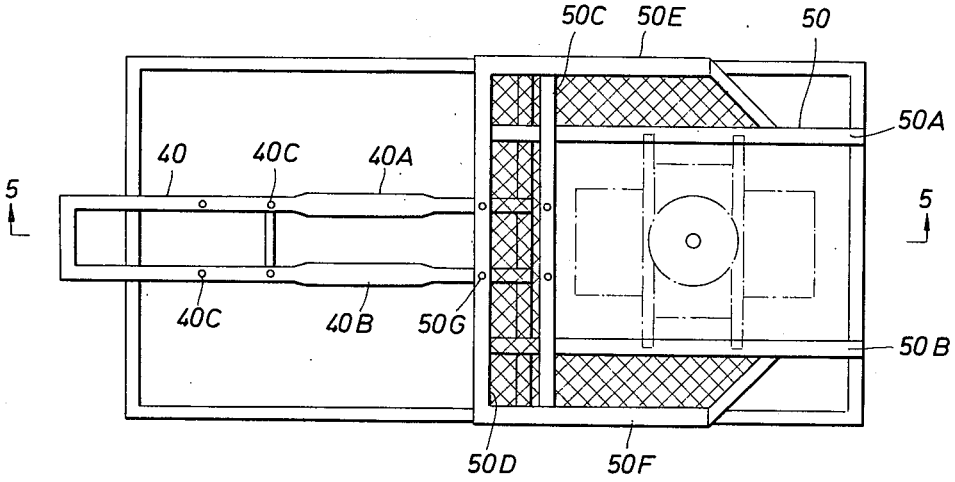

The other U-shaped gate member 50 is also shown most clearly in FIG. 3. The gate member 50 has its open end facing the opening 19 where the open end is defined by parallel bar members 50*a* and 50*b*. The bar members 50*a* and 50*b* are spaced apart a distance compatable with the outer diameter of a BOP. The bar members 50*a* and 50*b* attach to a pair of spaced transverse bars 50*c* and 50*d* which extend across the width of a frame member 19*d*. Side support bar members 50*e* and 50*f* extend along the length of the frame members 19*a* and 19*c* and attach to the BOP supporting bars 50*a* and 50*b*. As illustrated in FIGS. 2 and 3, the gate member 50 is movable between a retracted and extended position relative to the cellar opening 19. Means (such as tongue and groove connections not shown) are provided for suitable guiding of the gate members relative to the frame. The gate member 50 has its transverse members 50*c* and 50*d* disposed above the bars 40*a* and 40*b* (see FIG. 5) of the gate member 40 so that the gate members 40 and 50 may move horizontally between retracted and extended positions independently of one another. Selective locking means in the form of openings 40*c* and 50*g* are respectively provided in the bars 40*a* and 40*b* and the transverse bars 50*c* and 50*d*. Pins (not shown) are used to couple the gate members to one another. Hence, as shown in FIG. 4, both gate members 40 and 50 can be retracted and extended relative to the opening 19 in unison.

Figure 4:
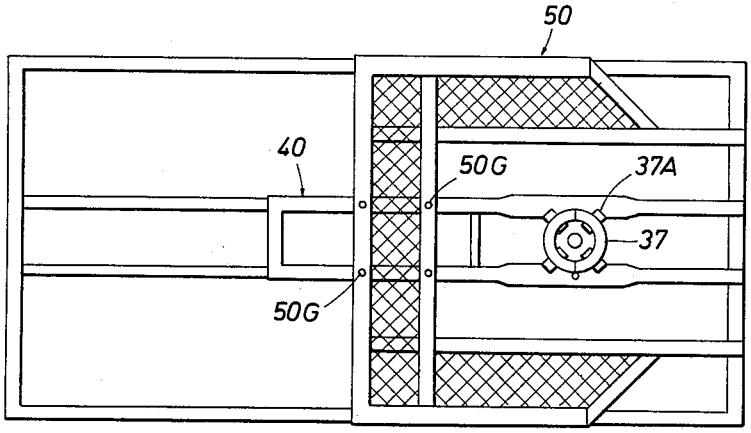
Figure 5:
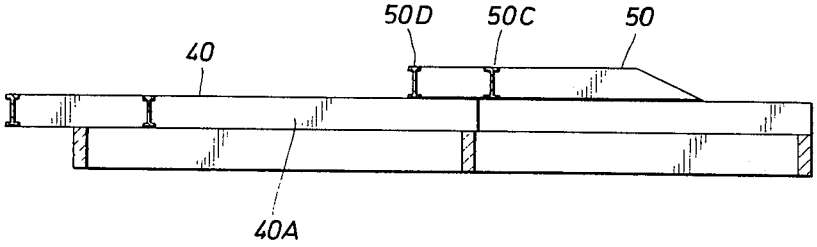
FIG. 5 is a view taken along line 5—5 of FIG. 3.

A riser spider 37 is conventional and is shown schematically in FIG. 4. The spider 37 includes hinged semi-cylindrical members with four equidistantly spaced latching fingers 37*a*. The latching fingers 37*a* releasably engage latching slots in a riser section for supporting the depending pipe load.

Figure 6:
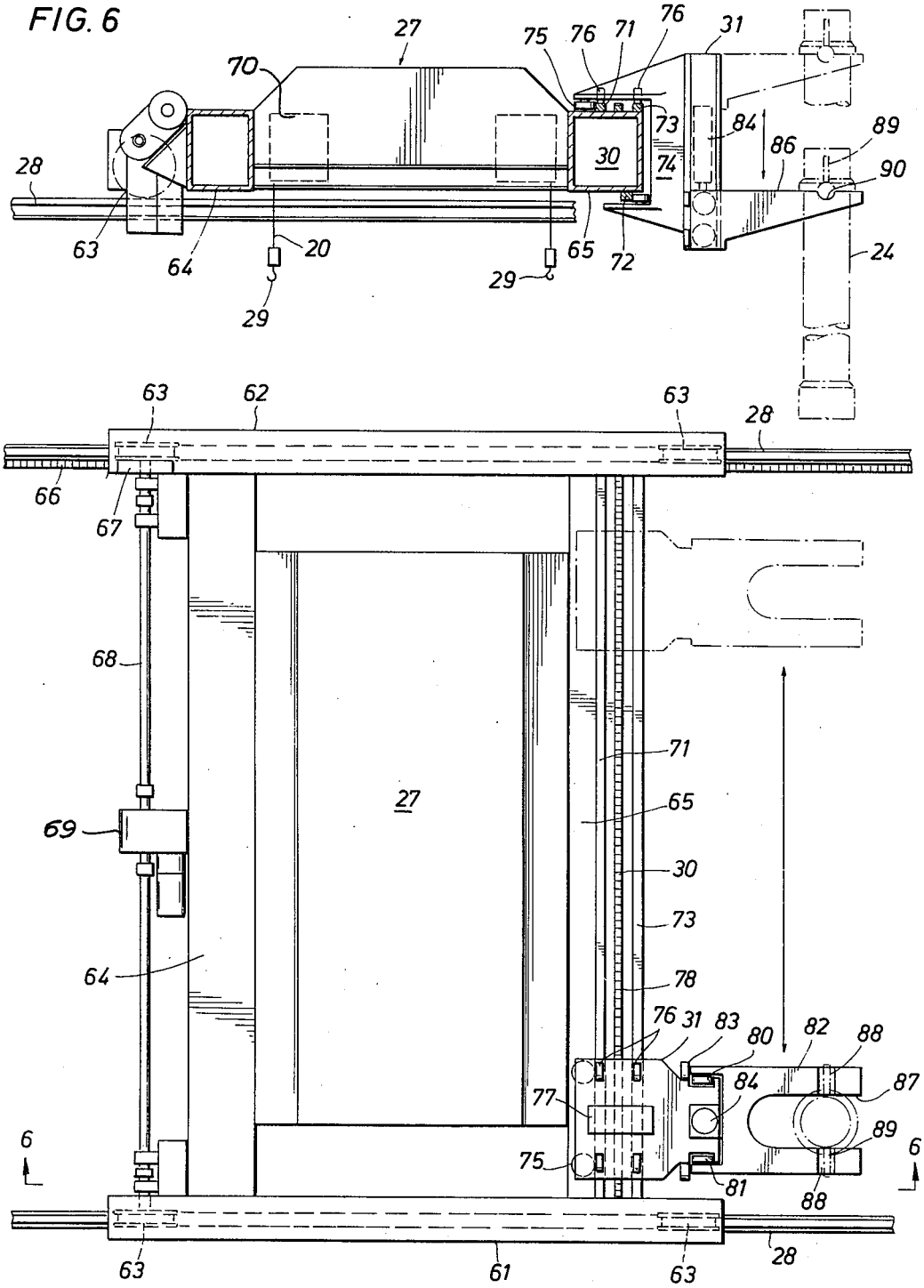
FIG. 6 is a side view taken along line 6—6 of FIG. 7.

Referring now to FIGS. 6 and 7, the riser pipe manipulating or transporting means are illustrated in side and plan view. The guide rails 28 are spaced from one another in a parallel fashion at the height above the cellar floor adequate to permit transportation of a riser pipe section in a vertical condition. Elongated end frame members 61 and 62 extend along the rails and carry journaled pairs of wheels 63. The frame members 61 and 62 are connected to transverse beam members 64 and 65 which can have type cross-sections. The frame and beam members 61, 62, 64 and 65 form a generally rectangular configuration which is movable in a horizontal direction by virtue of the wheels 63 and the track 28. A longitudinal rack 66 can be attached to one or both of the rails 28. A pinion 67 on the wheel shaft 68 engages the rack 66 for driving purposes. A motor and transmission means 69 on the beam 64 can be used to drive the shaft 68. As shown in FIG. 6, one or more hooks 29 attached to cable and spooling means 70 can be provided on the frame for picking up equipment such as the BOP means.

On the forward transverse beam 65, its upper and lower surfaces are provided with longitudinally extending guides 71, 72 and 73. A U-shaped frame member 74 has an upper arm with a vertically journaled set of rollers 75 which engage a side of the guide 71 facing away from the front of the beam 65. Horizontally journaled sets or rollers 76 in the frame 74 engage the upper surfaces of the guides 71 and 73. A vertically journaled roller in the lower arm of the frame member 74 engages an outer side of the lower guide 72. The guides and rollers provide a cantilevered rolling support for the frame member 74 on the transverse beam 65. A motor 77 on the frame member operates a pinion on the frame member 74 which engages a longitudinal rack 78 on the beam 65. Operation of the motor 77 traverses the frame member 74 relative to the beam member 65 in a horizontal direction transverse or perpendicular to the direction of travel of the beam member 65 on the rails 28.

The forward portion of the frame member 74 is provided with parallel vertical trackways 80 in opposing sides of the frame member. Guide rollers 81 are received in the guideways and are attached to a lifting frame 82. Additional side rollers 83 are provided so that the lifting frame 82 is movable vertically with respect to the frame member 74. Hydraulic means 84 are coupled between the frame member 74 and lifting frame 82 to accomplish relative vertical motion between the units. The lifting frame 82 has a generally flat upper surface 86 which has a U-shaped recess 87 sized to pass around the outer diameter of a riser section. A riser pipe section 24 has a diametrically opposed pin members 88 perpendicularly arranged relative to the axis of a riser pipe and supported by plate members 89 welded to the upper sides of the pins 88 and to the sides of a riser pipe section. The surface 82 of the frame 82 has recesses 90 therein to receive the pins 88 so that a riser section is interlocked by the pins to the lifting frame.

Figure 8:
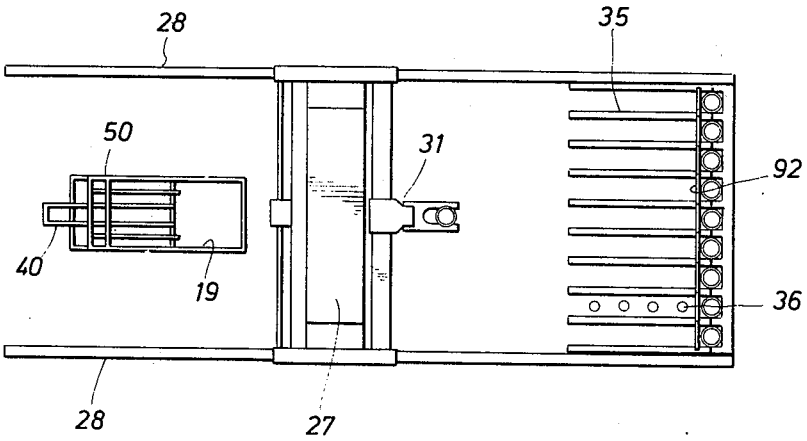
FIG. 8 is a schematic illustration of the cellar floor plan for transporting and storing riser pipe sections.

As shown in FIG. 8, the arms 35 which provide the upper support for the riser pipe sections can include transverse locking bars 92 to retain the upper portion of the pipes in a steady condition. The crane 27 can move to the stored riser pipe sections and the fork lift device can be lowered below the crane 27 to engage the pins 88 of a riser pipe section. The arms 35 for storage are located relative to the pins 88 so that the lifting portion of fork lift device can be inserted between the arms 35 and pins 88. The riser pipe sections are stacked and removed one at a time from side to side of the racking arms 35.

In summary of the overall operation of the system, the crane 27 first picks up the lower enc 33 of a BOP and moves it to the opening 19. The BOP portion 33 is lowered partially through the opening 19 with the door sections 40 and 50 in a retracted condition. Then, the door section 50 which has beams for supporting the BOP 33, is moved to an extended position where the door section 50 supports the BOP portion 33 relative to the cellar floor. The bridge crane 27 is then used to move an upper BOP section 32 over the lower section 33 and the BOP sections 32 and 33 are connected. After connection of the upper BOP section 32 to the lower BOP section 33, a single joint of a riser pipe that has been pre-positioned on the hook of the traveling block 16 by means of a running tool (not shown) is lowered through the rotary table 18 and connected to the top of the assembled BOP stack. The BOP stack is then picked up sufficiently for clearance and the door section 50 of the sliding door 20 is retracted to allow passage through the cellar deck opening 19 of the BOP. After the BOP has been sufficiently lowered to clear the cellar deck opening 19, a second pair of door arms 40 are engaged to the first set of arms 50 that previously supported the BOPs. The interconnection of the two sets of arms 40 and 50 is accomplished by inserting pins in the holes **40*c* and 50*g* while the door is in the retracted position. The door 20 is then manipulated again to an extended position with the now engaged second set of arms 40 that are spaced apart sufficiently to provide clearance for the riser and to support a riser spider 37 which will support the riser and BOP connected to it. The riser spider 37 is then installed around the riser and supported by the second set of arms 40. The riser is then set in it. The running tool (not shown) is then released and pulled up sufficiently to provide clearance for the next joint of riser. The fork lift device 31 is moved to the riser pipe section storage area and another riser pipe section is picked up vertically and transported in a vertical condition to the cellar opening 19 where it is lowered and coupled to the riser joint setting in the riser spider. The running tool (not shown) is attached to the traveling block 16 and is lowered through the rotary table 18 to attach to the connected riser pipe section. After connection with the running tool, the assembled stack is picked up sufficiently to release the spider and then is lowered until the riser pipe section is in position to be supported by the riser spider which is supported by the door section 40. The door section 40 then supports the depending stack by support of the riser pipe section by the door sections 40 and 50** coupled to one another.

While particular embodiments of the present invention have been shown and described, it is apparent that changes and modifications may be made without departing from this invention in its broader aspects; and therefore, the aim in the appended claims is to cover all such changes and modifications as fall within the true spirit and scope of this invention.

What is claimed is:

1. In an offshore drilling rig, a supporting mechanism for selectively supporting well tool elements of differing cross-sections where each such element has means for providing a downwardly facing abutment surface, said supporting mechanism being attached to a horizontal floor having an opening therein, means for moving said supporting mechanism horizontally relative to said floor between a retracted position leaving the opening unobstructed and an extended position over said opening, said supporting mechanism including superimposed supporting devices having upwardly facing abutment surfaces for respectively engaging downwardly facing abutment surfaces for a large cross-section well tool element and for a smaller cross-section well tool element, said supporting device for a large cross-section well tool being movable independently of said other supporting device, and means for releasably coupling said supporting devices to one another for conjoint movement whereby a smaller cross-section well tool can be supported in said opening.

2. In an offshore drilling barge having a drilling floor including drilling means mounted on said drilling floor, a cellar floor disposed below said drilling floor a distance adequate to receive an upright section of riser pipe, means between said floors for storing riser pipe in vertically positions with the bottom end of the riser pipe located close to the cellar floor, means on said storing means cooperating with a riser pipe for releasably retaining a riser pipe on said storing means, said riser pipe being free of said retaining means when raised a distance above said storing means, means defining an opening in said cellar floor through which riser pipe may be passed, means for releasably supporting riser pipe dependently with respect to said opening, and means between said drilling floor and said cellar floor for lifting a riser pipe section a distance less than the length of a riser pipe section, means for laterally displacing said lifting means and a riser pipe section in a vertical condition between said storing means and said opening in said cellar floor.

3. The apparatus as defined in claim 2 wherein said riser pipe storing means includes at least one pair of horizontally positioned arm members spaced to receive a riser pipe section, locking bars on said storing means extending transversely across said arm members and spaced to receive a riser pipe section.

4. In an offshore drilling barge, drilling means disposed on a drilling floor, a cellar floor door below said drilling floor and spaced therefrom by a distance greater than the length of a riser pipe section, means for storing riser pipe sections vertically between said floors with the bottom end of the riser pipe located close to the cellar floor, means on said storing means cooperating with a riser pipe for releasably retaining a riser pipe on said storing means, said riser pipe being free of said retaining means when raised a distance above said storing means, said cellar floor having an opening for passage of coupled riser pipe sections, means on said cellar floor for supporting coupled riser pipe sections depending from said cellar floor opening, means between said floors for lifting a riser pipe section a distance less than the length of a riser pipe section, means for supporting and for moving a riser pipe section in a vertical condition between said vertical storage means and said opening in said cellar floor.

5. In an offshore drilling barge having a drilling floor including drilling means mounted on said drilling floor, a cellar floor disposed below said drilling floor a distance adequate to receive an upright section of riser pipe, means between said floors for storing riser pipe in vertical positions, means defining an opening in said cellar door through which riser pipe may be passed, means for releasably supporting riser pipe dependently with respect to said opening, and means between said drilling floor and said cellar floor for lifting a riser pipe section and for laterally displacing a risesr pipe section in a vertical condition between said storing means and said suporting means, said releasable supporting means including two pairs of spaced apart arm members lying in a common plane, one of said pairs of arm members having a spacing there-between sized and adapted to receive and support a riser pipe section, the other of said pairs of arm members having a spacing there-between sized and adapted to receive and support a BOP means, and for operating each of said pair or arm members independently of one another in said plane whereby one or the other pair of arm members is employed for supporting means.

6. In an offshore drilling barge having a drilling floor including drilling means mounted on said drilling floor, a cellar floor disposed below said drilling floor a distance adequate to receive an upright section of riser pipe, means between said floors for storing riser pipe in vertical positions, means defining an opening in said cellar door through which riser pipe may be passed, means for releasably supporting riser pipe dependently with respect to said opening, and means between said drilling floor and said cellar floor for lifting a riser pipe section and for laterally displacing a riser pipe section in a vertical condition between said storing means and said supporting means, said lifting and displacing means including fork lift means, means for transporting said fork lift means in transverse, perpendicular directions relative to said cellar floor, means for vertically moving said fork lift means relative to said transporting means.

7. The apparatus as defined in claim 6 wherein transporting means includes a bridge span member supported by rollers on parallel tracks for transverse movement in one perpendicular direction and said fork lift means are supported by rollers on said bridge span member for transverse movement in the other perpendicular motion.

8. The apparatus as defined in claim 7 wherein said fork lift means includes spaced arm members with recesses for receiving lifting arm members on a riser pipe section.

9. In an offshore drilling barge, drilling means disposed on a drilling floor, a cellar floor door below said drilling floor and spaced therefrom by a distance greater than the length of a riser pipe section, vertical storage means for riser pipe sections between said floors, said cellar floor having an opening for passage of coupled riser pipe sections depending from said cellar floor opening and for supporting a riser pipe section between said floors, eans between said floors for moving a riser pipe section in a vertical condition between said vertical storage means and said supporting means in said cellar floor opening, said moving means including track means extending in one direction across said floor, bridge crane means movably mounted on said track means for movement in one horizontal direction, said crane means including a transverse beam extending between said track means, a fork lift means having a lifting element, and means for moving said lifting element vertically with respect to said fork lift means.

10. The apparatus as defined in claim 9 wherein each riser pipe section has means cooperating with said lifting element for releasably coupling a section to said lifting element whenever said lifting element raises a riser pipe section free of an underlying support.

* * * * *